US010766695B2

(12) United States Patent
Marcrander

(10) Patent No.: US 10,766,695 B2
(45) Date of Patent: Sep. 8, 2020

(54) ASSEMBLY AND METHOD OF USE FOR A PORTABLE WORK SURFACE

(71) Applicant: Marcrander-Marcrander Partnership, St. Louis, MO (US)

(72) Inventor: William Arthur Marcrander, St. Louis, MO (US)

(73) Assignee: RANDER PRODUCTS, LLC, St. Louis, MO (US)

( * ) Notice: Subject to any disclaimer, the term of this patent is extended or adjusted under 35 U.S.C. 154(b) by 57 days.

(21) Appl. No.: 15/841,697

(22) Filed: Dec. 14, 2017

(65) Prior Publication Data

US 2018/0170667 A1 Jun. 21, 2018

Related U.S. Application Data

(60) Provisional application No. 62/434,783, filed on Dec. 15, 2016.

(51) Int. Cl.

| | |
|---|---|
| ***B65F 1/14*** | (2006.01) |
| ***B65F 1/02*** | (2006.01) |
| ***B25H 1/04*** | (2006.01) |
| *B65F 1/00* | (2006.01) |

(52) U.S. Cl.

CPC ..... *B65F 1/1431* (2013.01); *B25H 1/04* (2013.01); *B65F 1/02* (2013.01); *B65F 1/14* (2013.01); *B65F 1/141* (2013.01); *B65F 1/006* (2013.01); *B65F 1/1473* (2013.01)

(58) Field of Classification Search

CPC ..... B65F 1/143; B65F 1/1431; B25H 3/06; B25H 3/00

USPC ..... 220/606

See application file for complete search history.

(56) References Cited

U.S. PATENT DOCUMENTS

| | | | | | |
|---|---|---|---|---|---|
| 2,528,872 | A | | 11/1950 | Dick | |
| 4,732,274 | A | * | 3/1988 | Bouton | A47G 19/065 206/1.7 |
| 5,092,480 | A | | 3/1992 | Waterston | |
| 5,350,065 | A | * | 9/1994 | Darrey | B25H 3/00 206/373 |
| 5,511,807 | A | | 4/1996 | Snyder | |
| 5,551,558 | A | * | 9/1996 | Bureau | A45C 9/00 190/11 |
| 5,713,499 | A | | 2/1998 | Daniel | |
| 5,730,451 | A | | 3/1998 | Walker | |
| 5,749,486 | A | * | 5/1998 | Porter | B65F 1/10 220/23.86 |
| 5,833,250 | A | | 11/1998 | Schier et al. | |

(Continued)

*Primary Examiner* — Shawn M Braden

(74) *Attorney, Agent, or Firm* — Sandberg Phoenix & von Gontard, P.C.

(57) ABSTRACT

A portable work area apparatus and method of use that creates a work area on top of a container having a container body defining a cavity for receiving storable items through an opening defined by a top end of the container body, with the portable work area apparatus having a body with a top portion, an opposing bottom portion, and the top portion having an outer edge and a top surface that defines a substantially flat working surface, and a downward extending attachment feature with downward extending attachment features for selective engagement with a portion or all of the top end of the container body when the apparatus is selectively placed onto the container for use of the apparatus and its working surface by a user.

30 Claims, 8 Drawing Sheets

(56) References Cited

U.S. PATENT DOCUMENTS

| | | | | |
|---|---|---|---|---|
| 5,954,195 | A * | 9/1999 | Krueger | A47G 19/065 206/217 |
| 6,138,827 | A * | 10/2000 | Marshall | B25H 3/00 206/373 |
| 6,145,856 | A | 11/2000 | Conti | |
| 6,179,306 | B1 | 1/2001 | Maxwell | |
| D489,858 | S * | 5/2004 | Hay | A47B 97/00 D34/20 |
| 6,761,368 | B2 | 7/2004 | Carter | |
| 6,880,470 | B2 | 4/2005 | Sidor et al. | |
| 6,953,199 | B2 | 10/2005 | Malloy, III | |
| 7,192,037 | B1 | 3/2007 | Pena | |
| D553,323 | S | 10/2007 | Moomey | |
| 7,337,901 | B2 * | 3/2008 | Phillips | A47J 47/16 206/349 |
| 7,469,798 | B1 | 12/2008 | Miller | |
| 7,878,364 | B1 | 2/2011 | Anderson | |
| 8,015,927 | B1 | 9/2011 | Helline | |
| 8,240,626 | B2 | 8/2012 | Kennedy | |
| D668,416 | S | 10/2012 | Thomas et al. | |
| 2004/0035866 | A1 | 2/2004 | Cestrone | |
| 2007/0216269 | A1 | 9/2007 | Kischitz | |
| 2009/0001088 | A1 | 1/2009 | Lamendola et al. | |

* cited by examiner

ASSEMBLY AND METHOD OF USE FOR A PORTABLE WORK SURFACE

CROSS-REFERENCE TO RELATED APPLICATIONS

This application claims the benefit of U.S. Provisional Application No. 62/434,783, filed on Dec. 15, 2016.

FIELD

The present disclosure relates to portable work surfaces and, more specifically to a work surface that attaches to another container.

BACKGROUND

The statements in this section merely provide background information related to the present disclosure and may not constitute prior art.

Trash and recycling receptacles, especially ones containing wheels, are being used more and more frequently. Some cities have purchased a receptacle for each home owner in that district and others are bought by individuals. With these becoming common place and taking up prime user space on a user's property such as in a garage or next to or on a driveway, there is a need to utilize this prime occupied space but turning it into something that can be used instead rather than being dedicated to a space consuming passive container that just sits around or six (6) days of the week waiting to be taken to the curb for weekly trash pickup.

The inventor herein has identified a need to utilize the space occupied by these passive trash and recycling receptacles or retainer by turning the receptacle or retainer into something that can be a utilized as an asset of the user instead of taking up the limited space in or around one's residence. The present invention solves the wasted space problem of trash receptacles taking up prime space by transforming the trash receptacle in a work station by transforming the trash receptacle into a free standing based for a flat usable work area where a user can complete varying tasks but that can be moved around to accommodate differing needs, to store readily accessible tools, and then removed as necessary once a week for taking the trash out to the curb for local weekly trash pickup.

SUMMARY

The inventor hereof has succeeded at designing a portable work surface that can be used for working with a household container as the support based for working around the house, in the garage or outside for performing various tasks. It is easily stored when not in use, and easily attached to a household container for use as a work surface or working area.

According to one aspect, a portable work area apparatus creates a work area on top of a container having a container body defining a cavity for receiving storable items through an opening defined by a top end of the container body. The portable work area apparatus having a body with a top portion and an opposing bottom portion. The top portion has an outer edge and a top surface that is substantially flat and that provides a working surface. The bottom portion has a bottom surface. Also included is a downward extending attachment feature coupled to the body and that is positioned below the bottom portion of the body with the downward extending attachment feature configured for selective engagement with at least a portion of the top end of the container body when the apparatus is placed thereon for selective attachment of the apparatus thereto.

A method of providing a portable work surface on top of a container, the method with the steps of positioning a portable work area apparatus having a work area on top above a top portion of a container having a container body defining a cavity for receiving storable items through an opening defined by a top end of the container body. The method using a portable work area apparatus having a body having a top portion and an opposing bottom portion, the top portion having an outer edge and a top surface that is substantially flat and provides a working surface, the bottom portion having a bottom surface, and having a downward extending attachment feature coupled to the body and positioned below the bottom portion of the body. The method also including the step of attaching the portable work area apparatus to a top end of the container by selectively engaging the downward extending attachment feature to at least a portion of the top end of the container body when the apparatus is placed thereon.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

FIG. 12 A and FIG. 12B are back views and side views, respectively of an exemplary embodiment of the portable work area apparatus selectively mounted or attached to a wheeled recycling bin used in some suburban areas.

FIG. 12 C and FIG. 12D are two different back views of additional exemplary embodiments of the portable work area apparatus selectively attached to a wheeled recycling bin wherein the assemblies include tool or utility storage areas for easy access by a user of the portable work area apparatus.

It should be understood that throughout the drawings, corresponding reference numerals indicate like or corresponding parts and features.

DETAILED DESCRIPTION

Figure 1:
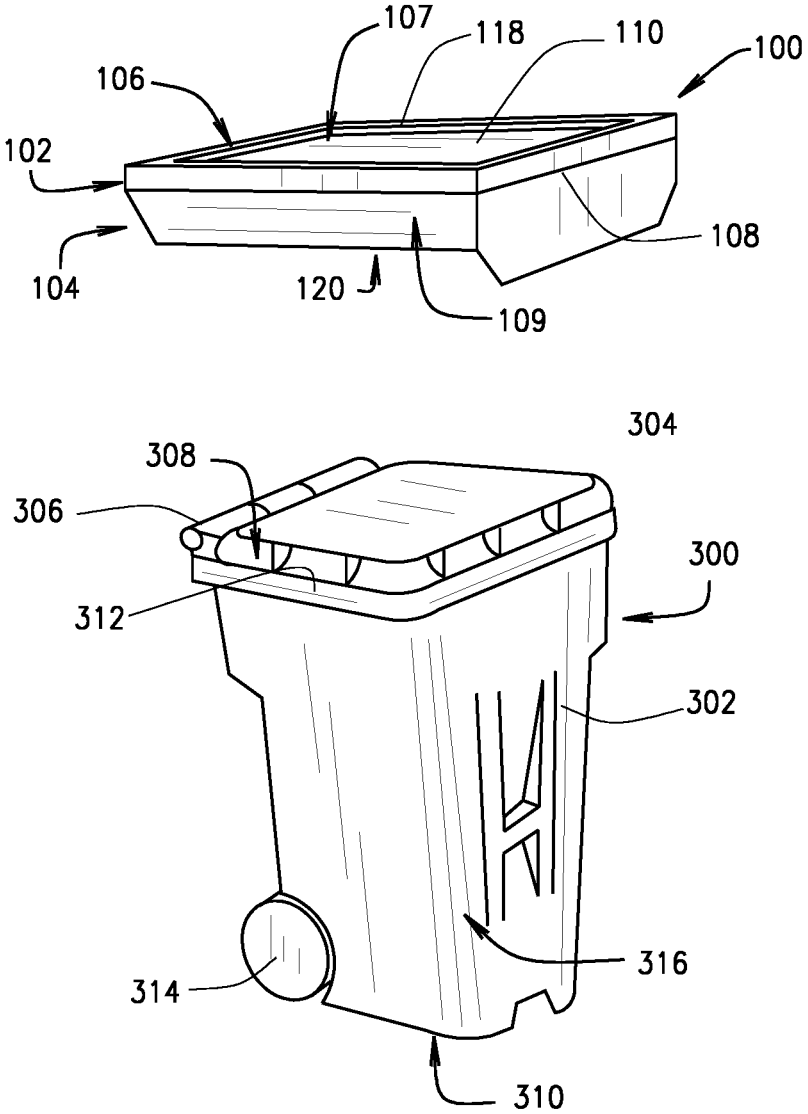
FIG. 1 is a top perspective view that includes a portable work area apparatus shown in relation to a container according to one exemplary embodiment.

The following description is merely exemplary in nature and is not intended to limit the present disclosure or the disclosure's applications or uses.

In one embodiment, a portable work area apparatus creates a work area on top of a container such as a trash can. Such a container has a container body that typically includes an outer portion and that includes or defines a cavity. As with the embodiment where the container is a trash can, the cavity is configured to receive and selectively dispense storable items such as trash or recyclables through an opening defined at a top end of the container body. In the past, such containers served no other purpose, but for temporary storage, but were often located in prime and easily accessible locations but that were also areas where a user may wish to also be using for work projects such as in or near a garage or driveway. As should be known to those of skill in the art after reviewing his description the portable work area can be used with any type of suitable container and can be adapted to old and new containers and still be within the scope of the present descriptions. By way of example, but not limited hereto, containers can include recycling containers that can contain wheels, recycling bins, trash cans that can be made from different types of materials including plastics and metals.

In this manner, the portable work area apparatus can be placed by a user onto the top of the container to enable the user to convert the container into a supporting structure for a work area for use by the user. The potable work area apparatus can be stored apart from the container when not attached or placed onto the container such as when not in use. The portable work area apparatus having a body that is substantial compact and boxed or circular shaped and having a thickness between 4 and 8 inches and an outer dimension of between 24 and 48 inches on each of its sides. As the portable work area apparatus can be configured of a plastic, such as by molding, or from a metal or wood based product, the weight can vary, but is typically such that the size, dimensions and weight enable the user to easily place the portable work area apparatus onto the container for use, to remove the portable work area apparatus when its use is no longer required, and to store the unused portable work area apparatus until the next use is desired.

As described herein, in some embodiments, the portable work area apparatus has a body with a top portion and an opposing bottom portion. The top portion has an outer edge and a top surface that is substantially flat which provides a user with a working surface when the apparatus is placed on top of a container. The bottom portion has a bottom surface, which is positionable in the direction of the container and proximate to the cavity or the top of the container, when the portable work area apparatus is placed on the container for use by the user. To help selectively secure the portable work area apparatus to the top of the container, the top portion can included a downward extending attachment feature coupled to the body that is positioned below the bottom portion of the body of the portable work area apparatus. The downward extending attachment feature or features can be configured to selectively engage with a portion or all of the top end of the container body when the apparatus is placed thereon for selective attachment of the apparatus thereto. In some embodiments, the downward extending attachment feature can include two or more extension features that are positioned for selective engagement with at least two opposing sides of the top end of the container body. The container body can include a handle proximate to the top end of the container body wherein the bottom portion of the body has a shape to conform to or receive the handle of the container body when placed for selective attachment thereon.

In some such embodiments, the two or more extension features are configured, adapted or otherwise dimensioned such that they selectively engage two opposing sides of the top end of the container body, or both of the two opposing sides of the top end, or one or more opposing portions if the container is round rather than being rectangular. By way of example, in one embodiment the two or more extension features are adapted to engage with two or more inner walls proximate to the top end of the container body. In some embodiments, at least two sets of two substantially opposing features engage the top end of the body of the container.

In another example, the two or more extension features are adapted to engage with two or more outer walls proximate to the top end of the container body. In other embodiments, the two or more extensions can include features for engaging both the outer and the inner walls of the top end of the container body such as those defining the cavity. These may be proximate to each other or offset in a staggered pattern that may be dependent on the shape of the top end of the container. In some embodiments, these features aid in the selective engagement of the portable work area apparatus to the container during use by the user.

The two or more extension features can be engaged or in abutment with an outer lip associated with the top end of the container body. In a different example the abutment of the two or more extension features with a top edge of the top end of the container body. The two or more extension features can also engage with the enclosure of the top end of the container body. In yet another example, the two or more extension features engage with a cover of the container body that is placed to cover the top end of the container body and selectively seal the cavity defined thereby.

In some embodiments, the downward extending attachment feature is a skirt configured to enclose the top end of the container body and engage or enclose all of or a substantial portion of the top end of the container defining the cavity. The skirt can be dimensioned to enclose an outer side of the top end of the container body. The skirt can be dimensioned for the enclose of an outer periphery of the top end of the container body defined by at least one of the top ends of the container body, a cover of the container body that is placed to cover the top end of the container body selectively sealing the cavity defined thereby.

In some embodiments, the downward extending attachment feature extends downward proximate to the outer edge of the top portion of the body. The downward extending attachment feature can have a top end and a bottom end and wherein the downward extending attachment can be attached to the outer edge of the top portion of the body and can include a top end that extends above the top surface of the body forming a raised periphery lip about the working surface.

In yet another embodiment, the downward extending attachment feature is coupled to the body of the portable work area apparatus by fixed attachment thereto forming a single assembled apparatus, or detachable attachment of two or more portions, such as may be assembled and disassembled by a user. In another embodiment, the body with an integrated downward extending feature is formed as a monolithic apparatus and the downward extending feature is coupled to the body as an integrated forming the monolithic apparatus, such as may be the case if the entire portable work area apparatus or a large portion of the apparatus is formed by a molding process.

In some embodiments, the body of the portable work area can include a raised periphery lip on at least a portion of the outer edge of the working surface; the raised periphery lip can extend upwards from the top surface of the top portion. The raised periphery lip can be positioned about the entire outer edge of the working surface.

In various embodiments, the downward extending attachment feature can be coupled to the body with a rotating hinge fixture wherein when the downward extending attachment feature is placed upon the top end of the container body, the body can be lifted upward and rotated about the rotating hinge fixture while maintaining the selective engagement of the downward extending attachment feature to the top end of the container body.

In another embodiment, the bottom portion of the body has a bottom portion shape that conforms to a shape of a cover of the container body that is placed on the container cover to cover the top end of the container body.

In yet another embodiment, the container body can include a handle proximate to the top end of the container body and wherein at least one of the downward extending attachment feature and body are configured to cover the top end of the container body when the apparatus is placed onto the container body, but to not cover or obstruct use access to the handle when the apparatus is placed on the container body.

In some embodiments, the body of the portable storage area can include a utility storage area, the utility storage area being configured for selective receiving and dispensing of user utilities including tools. The utility storage area can be formed in the body to include one or more orifices for receiving tools. The utility storage area can include a selectably enclosable storage compartment. The selectably closable storage compartment can use any type of features that are known in the art which include but are not limited to: hinges, slides, snaps, friction fit, etc.

In some embodiments, the portable work area can further have a utility storage component configured for selective receiving and dispensing of user utilities including tools and can include a selective attachment feature for selectively attaching the utility storage feature to the body, wherein the body includes an attachment feature for engaging with and selectively securing the utility storage component to the body by a user. The utility storage feature can be attached to the body by the use of any known techniques and can be adapted to old and new technologies. These techniques include but are not limited to the use or brackets, hangers, Velcro, nails, bolts, pop-rivets, by way of example. The utility storage component can include one or more orifices for receiving tools. The utility storage component can include a selectably enclosable storage compartment.

In some embodiments, the body of the apparatus includes an orifice between the top surface and the bottom surface that provides access by the user from outside of the top surface of the portable work area apparatus that is placed on the container to the cavity of the container body that is covered by the apparatus. In other words, even though the use has placed the apparatus onto the top end of the container which includes placing the body of the apparatus onto the top end and placing the downward extending attachment features into selective engagement with at least a portion of the top end of the container body, the user can still readily access the cavity for placement of articles therein, such a the dispensing of trash into a container that is a trash receptacle. The body can include a cover over the orifice such as may be implemented into the top working surface that is selectably movable by a user to cover the orifice to provide a full working surface but that can be selectively uncovered by the user to access the orifice and therefore the cavity of the container. The cover can be selected from the group consisting of those known in the art which can include but are not limited to a sliding door, a hinged door, a flap, and a removable plug.

The container body can be any type of suitable container for use as a base and can include, but is not limited to, a garbage can, a storage container, a storage cart, and a recycling collector.

In embodiments, the portable work area can be made where at least one of the body and the downward extending attachment feature is composed of a material selected from the group consisting of a wood, a plastic, a metal, a composite or other materials new and old can easily be adapted.

The portable work area can include at least one of the body or the downward extending attachment feature including a handle for aiding the user manipulation of the apparatus.

The portable work area can have a body consisting of a shape selected from the group of a rectangular, a circle, and a trapezoid, and wherein the downward extending attachment feature as a shape selected from the group of a rectangle, a circle, and a trapezoid, the shape of the downward extending attachment feature being independent of the shape of the body and having a shape that conforms with a shape of the top end of the container body for the selective attachment of the apparatus thereto.

The portable work area can have a top end of the container body that includes an outer lip about at least a portion of the periphery of the top end, and wherein the downward extending feature is configured to abut and enclose the outer lip of the top end of the container for the selective attachment of the apparatus to the container.

The portable work area can consist of the body including a receptacle for providing easily accessible power to a user using the working surface of the apparatus.

Referring now by way of exemplary embodiments, we refer to the figures that shown various embodiments of the apparatus and their selective placement and use with several different types of suitable containers.

Referring first to FIG. 1, as shown by way of example is a top perspective view of a portable work area apparatus 100 is shown positioned above a top end of an exemplary container 300 on which the apparatus 100 can be selectively attached for use by a user as a new work area rather than being wasted space. A body 102 includes a top portion 106 that defines a top surface 107 and a working surface 110 that in some embodiments can be the same surface. The body 102 also has a bottom portion 108 that has or defines a bottom surface 109. In some embodiments, as shown in FIG. 1, the top portion 106 includes a rim 118 that is around all or a portion of the top surface 107 for defining an outer periphery preventing working objects placed on the working surface 110 from accidentally following off the working surface 110. Apparatus 100 includes a downward extending feature 104 that can contain an engagement feature 120 that can consist of two or more downward extending devices or, as shown in FIG. 1, be made into a skirt. As used herein, downward refers to the direction away from the top surface 107 and towards a ground or floor surface on which the container 300 has its bottom end 310 resting or placed. The engagement feature 120 can be constructed to fit around or in some embodiments engage by resting on the outer lip 312 of the top end 308 of the container body 302 of container 300.

The bottom portion 108 can be made to fit about or around the container cover 304 if the container cover 304 is in the closed position when placement of the portable work area apparatus 100 onto the container 300. This fitment of the bottom portion 108 or the bottom surface 109 can be configured or adapted to conform to the shape of the cover 304, or to the top end 308 if the cover is in the open position. In either case, the apparatus 100 can have these components and features adapted to conform or operate with a container handle 306 that is on the outside of the container body 302. In some embodiments, such a configuration can include the dimensions or shape of the apparatus 100, such as the downward extending feature 104 as well as other components and features so that the handle 306 can be grasp by a user for moving the container 300 with the apparatus 100 attached thereto. When the portable work area apparatus 100 shown in FIG. 1 is attached to container 300, the container 300 can still be moved around using the container wheels 314 as in some embodiment the container handle 306 is accessible. The container cavity 316 can also be accessed in some embodiments. The container bottom 310 provides support and stability when the portable work area apparatus 100 is being used.

Figure 2A:
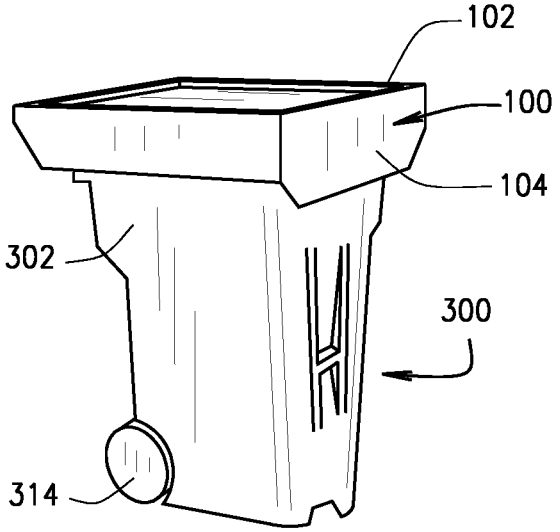
FIG. 2A is a top perspective view of the portable work area apparatus shown selectively attached to a container illustrating an exemplary implementation of the portable work area according to one exemplary embodiment.
Figure 2B:
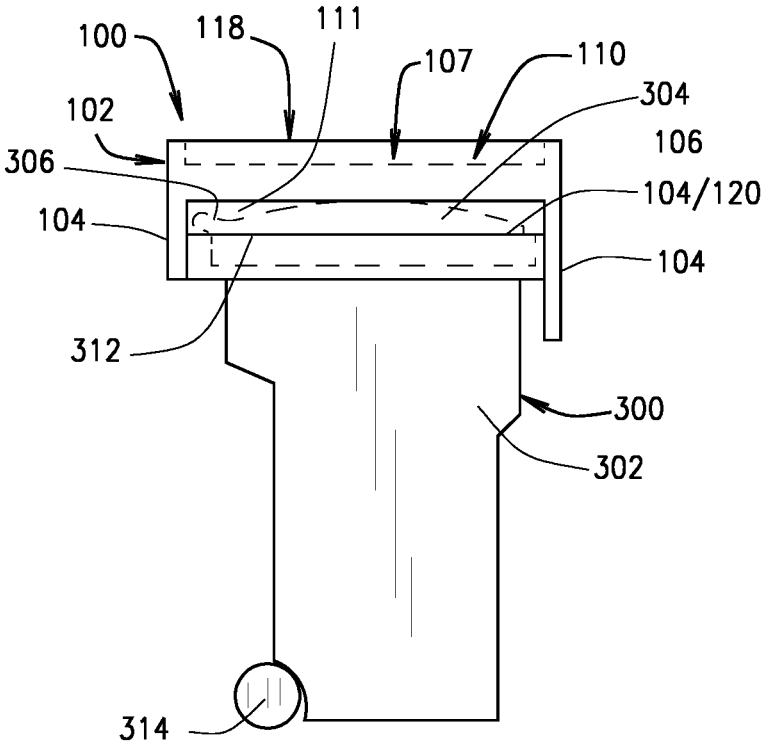
FIG. 2B is a cut view of the portable work area selectively attached to a container according to the exemplary embodiment of FIG. 2A.

In FIGS. 2A and 2B, shown by example, a portable work area apparatus 100 can include selective attachment with one particular type of container 300 such as a wheelable recycling container 300 by way of example. The apparatus body 102 is configured to be placed and sit on the container body 302 and the downward extending feature 104 selectively secures the portable work area apparatus 100 to the container body 302 during use or placement by a user on the container body 302. FIG. 2B shows a cutaway side view of one embodiment of the portable work area apparatus 100. The engagement feature 120 engages or at least rests upon the upper lip 312 of the top end 308 of container body 302 for selectable attachment thereto. In this embodiment, the bottom portion 108 of the apparatus 100 can be adapted such as by shaping and dimensions to receive and house the container handle 306 and the container cover 304 within the downward extending features 104. A cavity 111 can be formed with open space left after selective engagement that receives the cover 304 and the handle 306 of the container 300 when placed thereon. In this embodiment, the downward extending feature 104 is shown with varying lengths on different sides as the lengths of each side and that can be independent of the other sides depending on needs for selective attachment to the container body 302 and also the visual appeal of the apparatus 100 alone or as mounted onto the container body 302.

Figure 3:
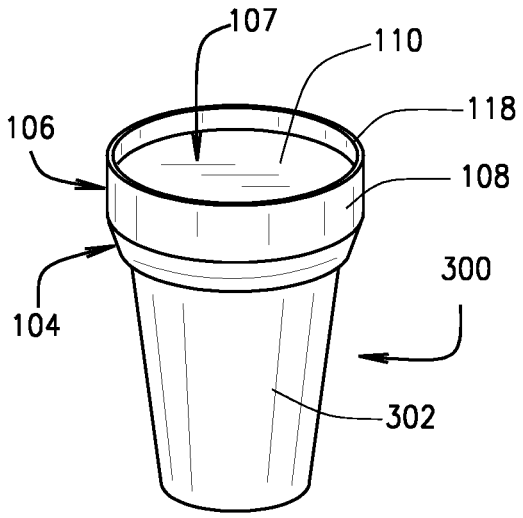
FIG. 3 is a top perspective view of a portable work area according to a secondary embodiment or a round container.

FIG. 3 illustrates one exemplary embodiment of a portable work area apparatus 100 that is adapted and dimensioned to contain a mostly circular top surface 107 and work surface 110, when mounted to a round container 300. The container 300 or round receptacle 300 can be of any shape and dimension as the rounded work area apparatus 100 is not limited to being used with a round container and vice versa. The shape of the container 300 can be oval, trapezoidal circular, rectangular, and be adapted to fit a variety of shapes without deviating from the present disclosure. The shape of the work area apparatus 100 can also be oval, trapezoidal circular, rectangular, and be adapted to fit a variety of shapes without deviating from the present disclosure.

Figure 4A:
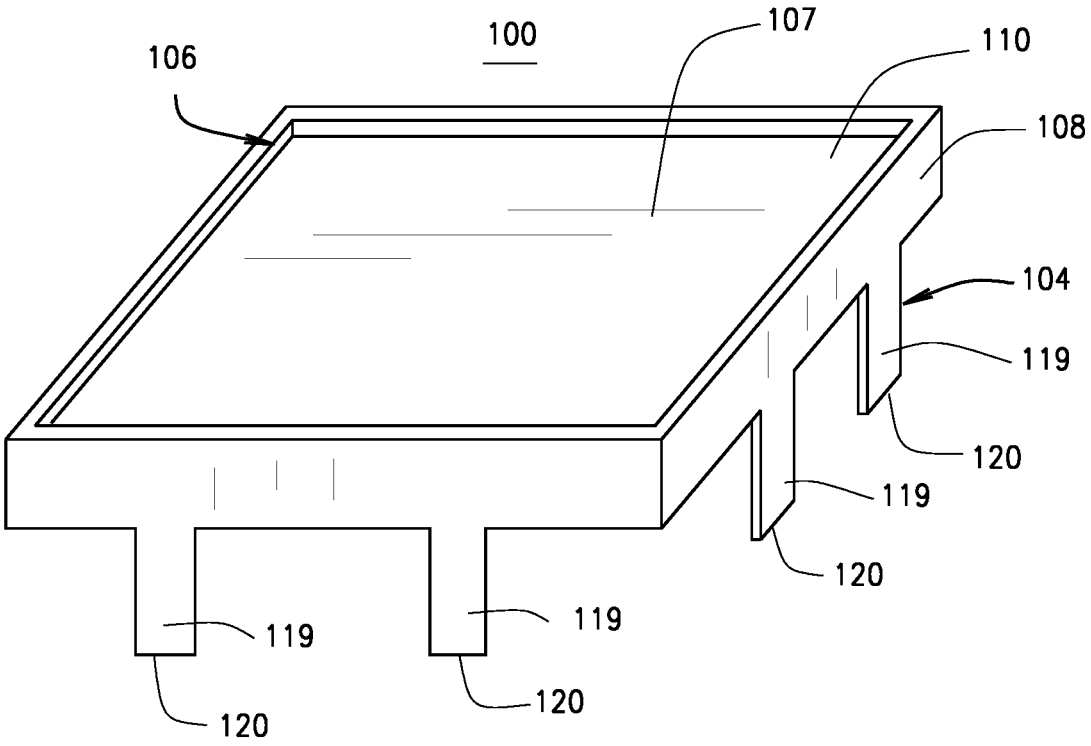
FIG. 4A is a perspective view of a portable work area according to a secondary exemplary embodiment.
Figure 4B:
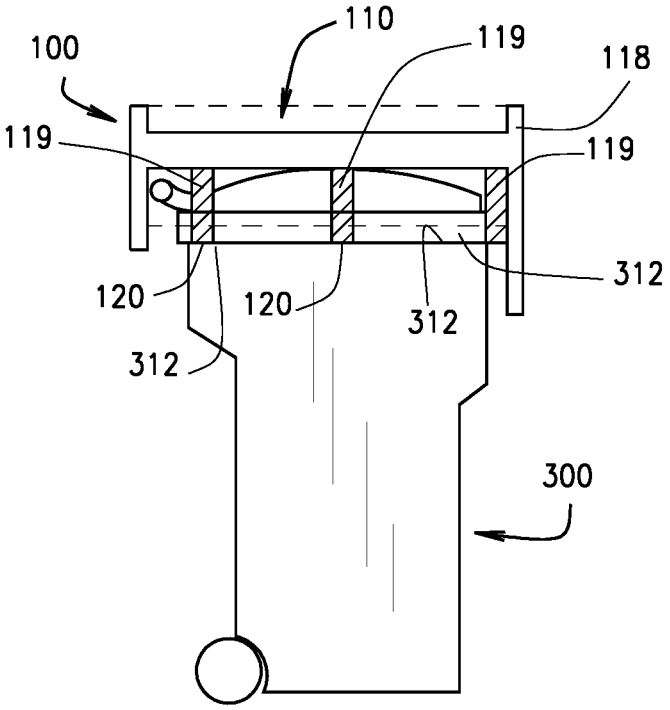
FIG. 4B is a side cut view for the portable work area of FIG. 4A.

FIGS. 4A and 4B illustrate an embodiment of the portable work area apparatus 100 where it is configured to have two downward extending features 104 on each of four side of a rectangular shaped apparatus body 102 for selectively securing the work area apparatus 100 to the top end 308 of the container 300. The portable work area apparatus 100 can also contain more than two downward extending features 119 on one or more sides for aesthetic appeal or increased functionality or adaptability to a particular type of container 300. Top portion 106 includes a top surface 107, a work surface 110 and a raised rim 118. Downward extending feature 104 can contain engaging ends 120 and extending support legs 119 that are extensions of the body 102, as in contrast where the downward extending feature 104 is a skirt. Each downward extending feature 104 can have the same or a different shape, size or contour as may be adapted for the particular container 300.

FIG. 4B is a cutaway view of the work area apparatus 100 as shown in FIG. 4A but showing placement of the apparatus 100 onto a container 300. As such, the engaging ends 120 of the extending support legs 119 of the downward extending features 104 are configured to contact or engage with the top portion or surface of the upper lip 312 of the top end 308 of the container body 312 to selectively engage the portable work area apparatus 100. The extending support legs 119 of the downward extending features 104 containing an engagement feature 120 that can rest on or secure next to the upper lip 312 of the top end 308 of the container body 312. As also shown in this exemplary embodiment, the downward extending feature 104 not only include the extending support legs 119 that engage the upper lip 312, but also includes an outer skirt 104 that extends outside of the top end 308 for completely encircling and enclosing the top end 308 and the upper portion of the container body 302 including the handle 306 when the apparatus 100 is placed onto the container 300.

Figure 5:
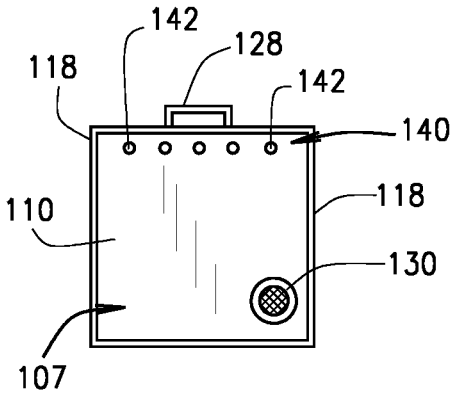
FIG. 5 is an illustration of the top view of a portable work surface area according to an exemplary rectangular embodiment.

FIG. 5 is a top view of one embodiment of a work area apparatus 100 illustrating various features and options for the top surface 107 and the work surface 110. In this example, an orifice 130 is provided in the work surface that allows for access to the container cavity 316 that is below the work area apparatus 100 and below the work surface 110. In some embodiments, the orifice 130 is a hole and is always open. In other embodiments, the orifice 130 can be configured to be selectably closed by way any technologies that are known now and can be easily adapted to for those implemented in the future. These include a slide, a hinged door, a plug, etc. Portable work area apparatus 100 can be made to function while lid of container 300 is open or the container 300 may not contain a cover 304. A hole or chute can be designed between orifice 130 and container cavity 316 in some embodiments. Raised lip 118 helps keep items on the work surface 107. The portable work area apparatus 100 can be easily moved using handle 128. Utility storage component 140 can contain storage holes 142 that enable the convenient placement of tools and other accessories such as lights, which can be used while using the work surface 110 and/or jobs located in the vicinity.

Figure 6:
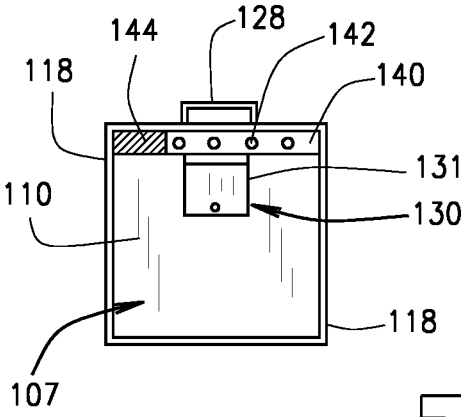
FIG. 6 is an illustration of the top view of a portable work surface area according to an exemplary embodiment that contains a hole.

FIG. 6 is a top view of another embodiment of a portable work area apparatus 100. In this embodiment, a hinged door 131 allows selectable use of the orifice 130 for access to the cavity 316 of the container 300 that is underneath. The portable work area apparatus 100 includes a utility storage component 140 that can include mounting features such as storage holes 142 and/or a storage area 144 that can be an open or closed container. Storage area 144 can be a recessed area for holding small item such as nails, bolts. Storage area 144 can be a magnetized area to help secure small items that can be hard to track and located if they fall. Storage area 144 can also contain a lid attached by various means. The orifice 130 can be covered by a hinged door 131 that only allow access to the cavity 316 of the container 300 below when the user wants or requires it.

Figure 7:
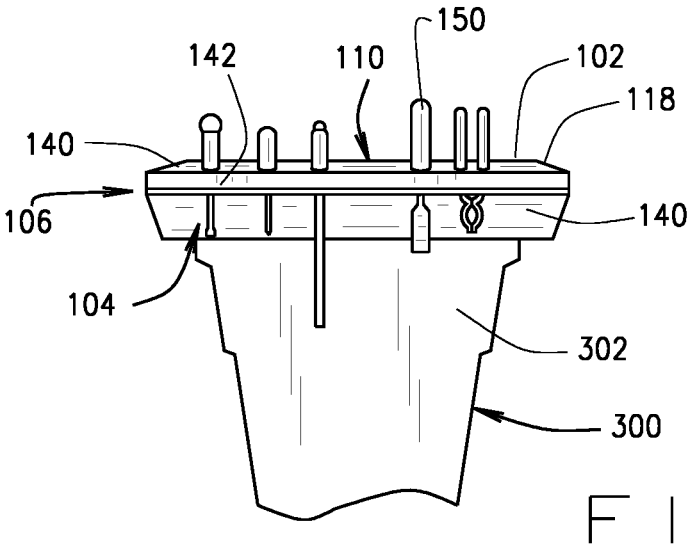
FIG. 7 is a side perspective view of an exemplary embodiment of the portable work area that contains a storage area.
Figure 8:
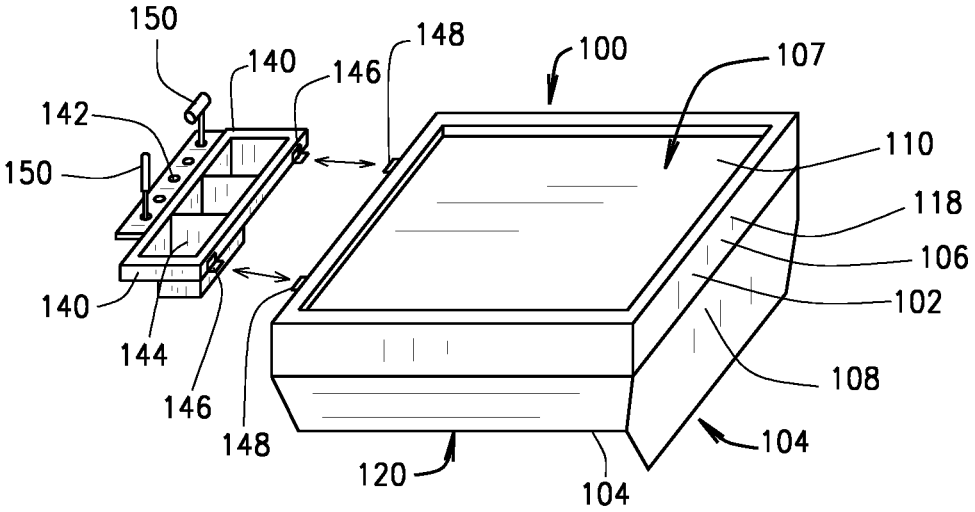
FIG. 8 is an upper perspective view of a portable work area that contains a selectively attachable attachment according to an exemplary rectangular embodiment.

FIG. 7 is another exemplary embodiment of a utility storage area 140 for the portable work area apparatus 100. The utility storage area 140 can contains and include features including storage holes 142. Tools 150 can easily be placed nearby the work surface 107 being used by a user. FIG. 7 shows that portable work area apparatus 100 can have sides that extend horizontally outward increasing the functional area being used or differing needs and uses. The utility storage area 140 can be integrally formed with the portable work area apparatus 100 or can be selectably attached and detachable by any suitable means, the later embodiment being shown in the embodiment of FIG. 8 as one example. As shown here, a utility storage component 140 is selectably attached to portable work area apparatus 100 by attachment means 146 and 148. Attachment means can be the use of clips, hinges, hooks, or engaging features, by way of examples. Utility storage component 140 contains a storage area 144 that is recessed to increase the area within. Downward extending feature 104 is shown as a mostly skirt that has engagement ends 120 that selectably attach with upper lip of the container 312.

Figure 9:
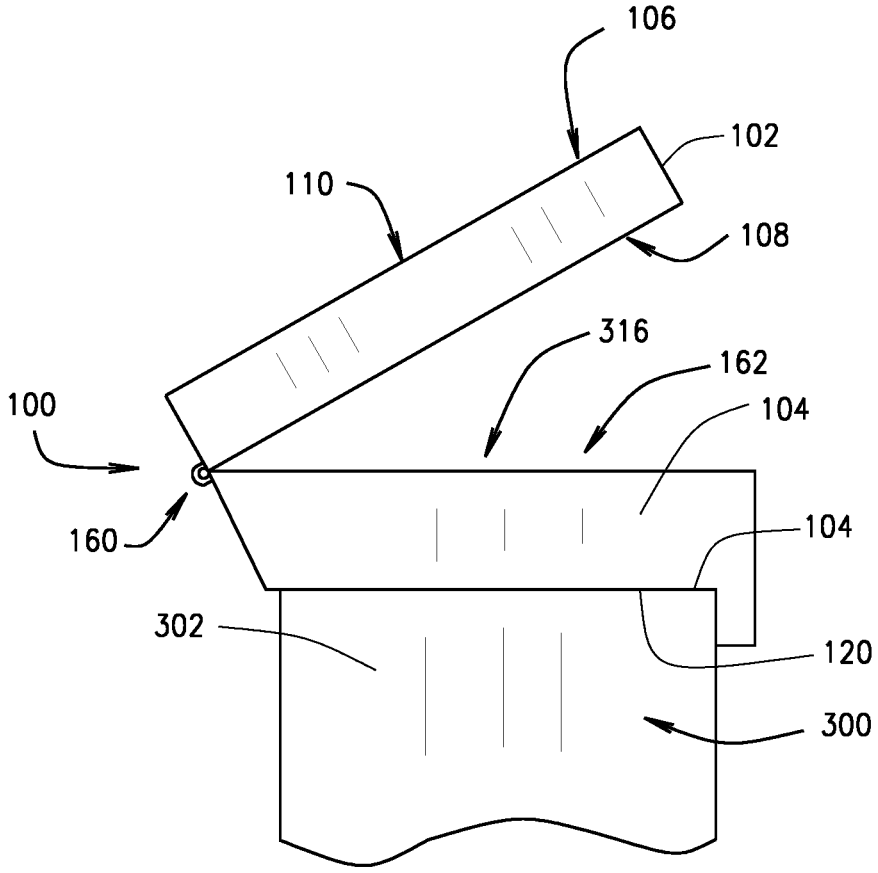
FIG. 9 is a side view of a portable work area wherein an upper portion can be lifted to gain access to the container according to one exemplary embodiment.

FIG. 9 illustrates another exemplary embodiment of a portable work area apparatus 100 wherein the body 102 of the portable work area apparatus has a top portion 106 that is flexibly attached to bottom portion 108 by a hinge 160. In this manner, the top portion 106 can be manipulated by a user about the hinge 160 to lift the top portion 106 to allow the user to access the cavity 316 of the container including possibly the full opening of the top end of the cavity 316 of the container 300 without fully removing the portable work area apparatus 100 as the bottom portion 108 of the apparatus body 102 remains mounted or attached to the top end 308 of the container body 102. Top portion 106 contains the work surface 100 and bottom portion 108 contains the downward extending features 104 and other components as described herein for engaging and mounting to the container body 302, such as the skirt, and engagement feature 120. In this embodiment, cavity 162 is formed in the space that is created when top portion 106 or lifted away from bottom portion 108. It should be known that hinge 160 can be attached on any of the sides or on a portable work area apparatus 100 that is more circular in nature.

Figure 10:
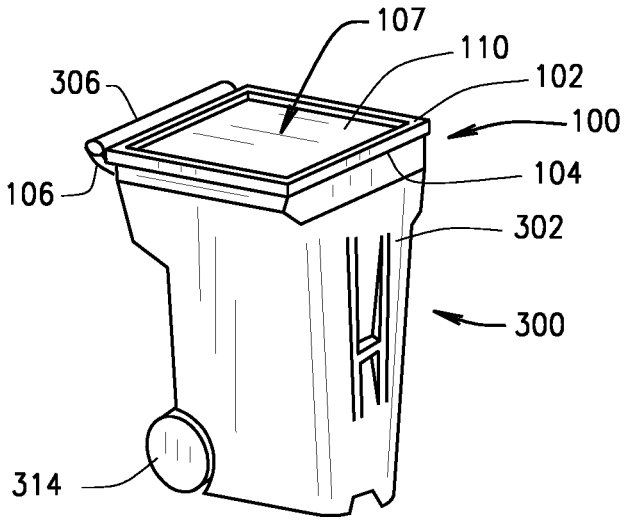
FIG. 10 is a perspective view of a portable work area wherein the handle of a container is still accessible with the work area attached according to an exemplary embodiment.

FIG. 10 is yet another embodiment wherein the portable work area apparatus 100 has a body 102 that is dimensioned to cover and mount to the top end 308 of the container body 302, but not to enclose or cover the container handle 306. In this embodiment, the container handle 306 can be easily accessed and manipulated even when the portable work area apparatus 100 is selectably attached to the container body 302. This arrangement can allow or enable for increased mobility and manipulation of the container 300 with the portable work area apparatus 100 mounted thereon. This is particularly so when the container 300 has wheels 314. The increase mobility can be an asset to a user when working around the house. By way of example only, this can be utilized when working on a car and the need for tools, and the new work surface provided by the portable work area apparatus 100 that is mounted onto a container 300 with wheels 314 can be moved to a more convenient location for a particular project, such as next to a vehicle or next to a BBQ pit, or other work location.

Figure 11A:
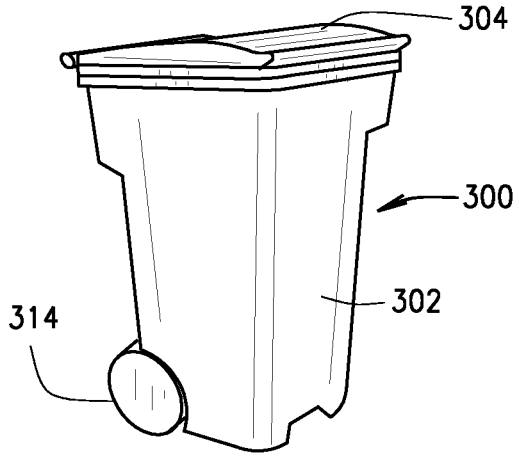
FIG. 11A is a side perspective view of a known standard trash receptacle container that can be used with the portable work area according to an exemplary embodiment.
Figure 11B:
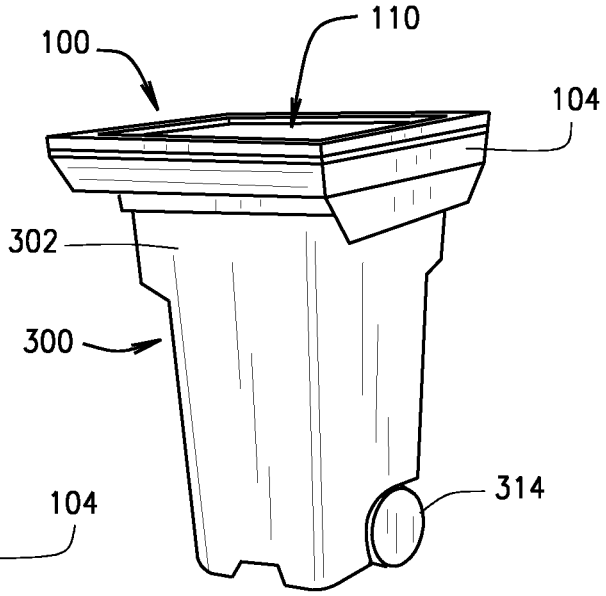
FIGS. 11B and 11C are front perspective view and back view, respectively, of an embodiment of a portable work area apparatus in use after being placed onto the top end of the known standard trash receptacle as shown in FIG. 11A according to an exemplary embodiment.
Figure 11C:
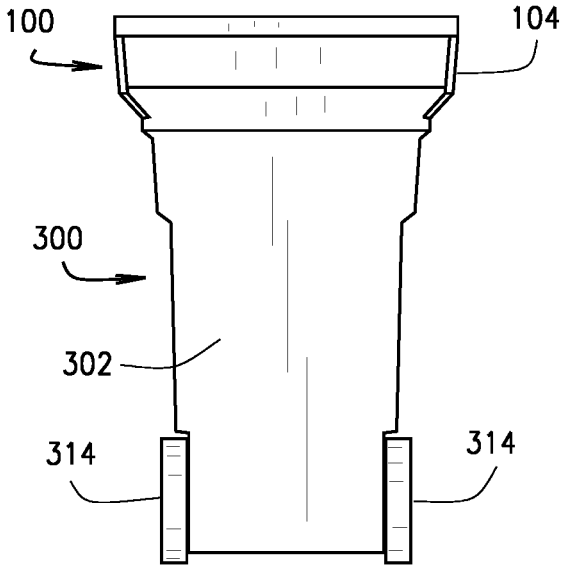
Figure 12A:
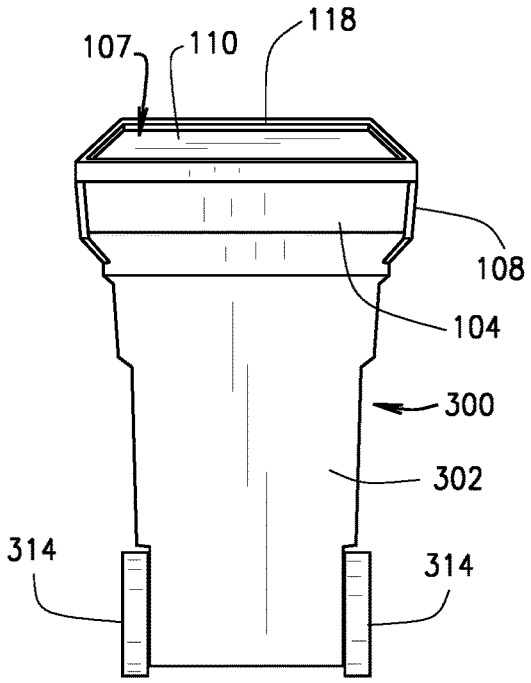
Figure 12B:
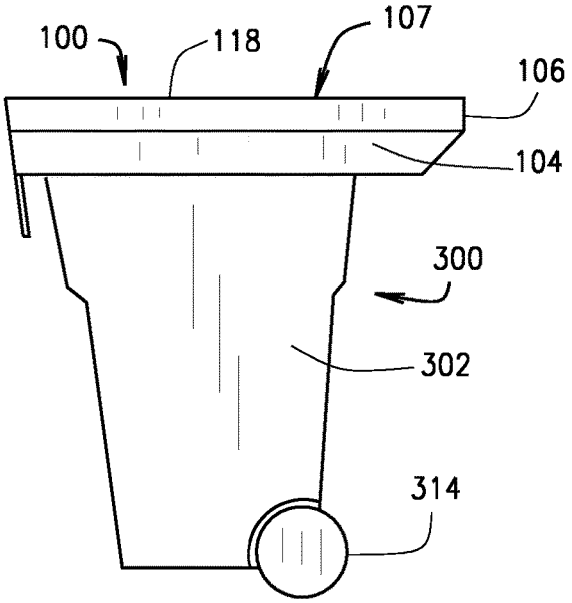
Figure 12C:
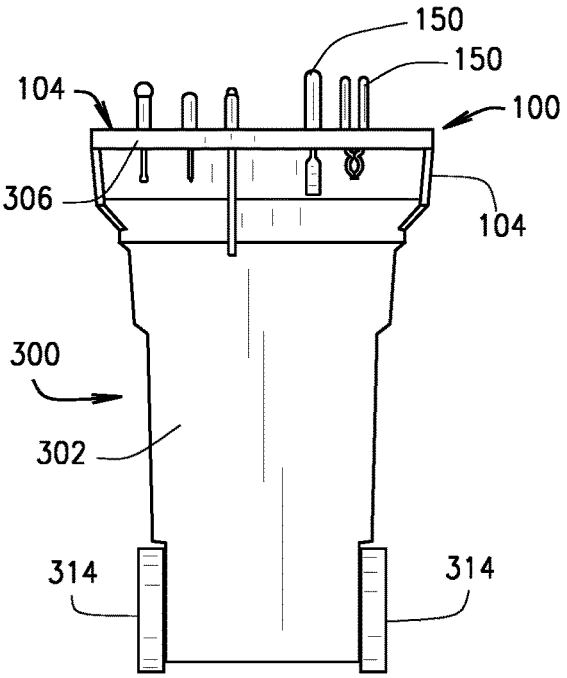
Figure 12D:
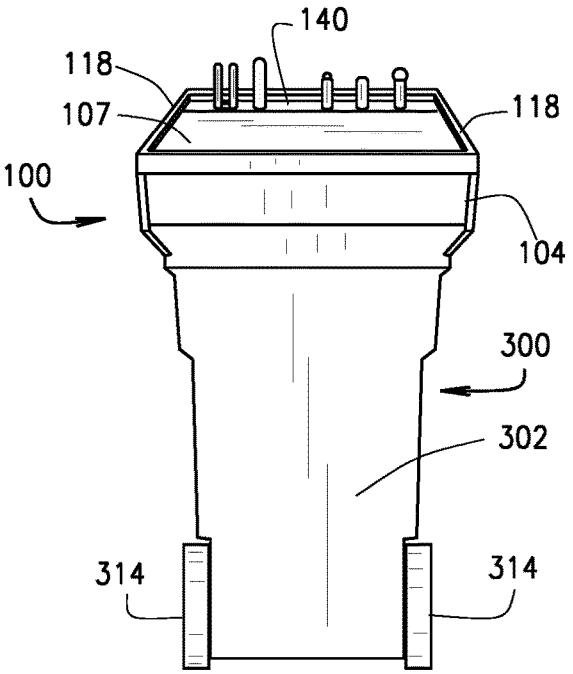

FIGS. 11A, 11B, and 11C are additional views of a known standard trash receptacle container 300 that can be used with the portable work area apparatus 100 according to an exemplary embodiment as described herein.

FIGS. 12A, 12B, 12C and 12D are further views of a known standard wheeled trash receptacle container 300 that can be used with the portable work area apparatus 100 with an integrated utility storage area 140 according to one exemplary embodiment.

In operation, one of ordinary skill in the art will understand that the described embodiments can be used as a method of providing a portable work surface on top of a container. In some embodiments, the method can include operational steps including the positioning of the portable work area apparatus 100 having a work area on top above a top portion of a container having a container body defining a cavity for receiving storable items through an opening defined by a top end of the container body. Some embodiments of the method use one or more embodiments and features of the portable work area apparatus 100 having a body having a top portion and an opposing bottom portion, the top portion having an outer edge and a top surface that is substantially flat and provides a working surface, the bottom portion having a bottom surface, and having a downward extending attachment feature coupled to the body and positioned below the bottom portion of the body and optional features as described above. The method embodiments can also includes a step of attaching the portable work area apparatus 100 to a top end of the container by selectively engaging the downward extending attachment feature to at least a portion of the top end of the container body when the apparatus is placed thereon.

As one of ordinary skill in the art, as can be seen from the above, one or more embodiments as disclosed herein provide for a new portable work surface that can be attached to a container as a base that provides for efficient use of the space and is convenient.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A portable work area apparatus creating a work area on top of a portable trash/recycling container having a container body having a rectangle shape with four sides and a top end, a cavity defined by the top end for receiving storable items through an opening, the container body having one of the four sides having a container handle proximate to the top end, an outer lip proximate to and on an outer portion of the top end of the container body, a container cover for selectively covering the cavity and selectively engaging the outer lip of the container body when in a closed position, and having wheels for movement of the portable trash/recycling container, the apparatus comprising:

an assembly body having a top portion and an opposing bottom portion, the top portion having an outer edge and a top surface that is substantially flat and provides a working surface, the bottom portion having a bottom surface and an outer edge; and a downward extending feature coupled to the outer edge of the top portion of the assembly body and having an outer wall with an outer surface and an inner surface extending downward therefrom and below the bottom portion of the assembly body, the downward extending feature having an engagement feature formed below the outer edge of the top portion of the assembly body with each configured for selective resting engagement with the outer lip of the top end of the container body when the apparatus is placed thereon for selective attachment of the apparatus thereto.

2. The apparatus of claim 1 wherein the engagement feature of the downward extending feature includes two or more extension features positioned for selective engagement with the outer lip of at least two opposing sides of the top end of the container body.

3. The apparatus of claim 2 wherein the two or more extension features are configured for selective engagement with the outer lip of the container body and configured for also at least one engagement selected from the group consisting of:

(a) engagement with two or more inner walls proximate to the top end of the container body;

(b) engagement with two or more outer walls proximate to the top end of the container body;

(c) abutment with a top edge of the top end of the container body;

(d) enclosure of the top end of the container body; and (e) engagement with the container cover that is placed to enclose the top end of the container body and selectively seal the cavity defined thereby.

4. The apparatus of claim 1 wherein the downward extending attachment feature is a skirt configured for enclosing the top end of the container body.

5. The apparatus of claim 4 wherein the skirt is dimensioned for enclosing an outer side of the top end of the container body.

6. The apparatus of claim 4 wherein the skirt is dimensioned for enclosing an outer periphery of the top end of the container body including the container cover.

7. The apparatus of 1 wherein the downward extending attachment feature extends downward proximate to the outer edge of the top portion of the assembly body.

8. The apparatus of claim 7 wherein the downward extending attachment feature has a top end and a bottom end and wherein the downward extending attachment is attached to the outer edge of the top portion of the assembly body and includes a top end that extends above the top surface of the assembly body forming a raised periphery lip about the working surface.

9. The apparatus of claim 1 wherein the downward extending attachment feature is coupled to the assembly body by fixed attachment thereto forming a single assembled apparatus.

10. The apparatus of claim 1 wherein the assembly body and the downward extending feature of the assembly body are formed as a monolithic apparatus and wherein the downward extending feature is coupled to the assembly body forming the monolithic apparatus.

11. The apparatus of claim 1 wherein the assembly body includes a raised periphery lip on at least a portion of the outer edge of the working surface, the raised periphery lip extending upward from the top surface of the top portion.

12. The apparatus of claim 11 wherein the raised periphery lip is positioned about the entire outer edge of the working surface.

13. The apparatus of claim 1 wherein the downward extending attachment feature is coupled to the assembly body with a rotating hinge fixture wherein when the downward extending attachment feature is placed upon the top end of the container body, the assembly body configured to be lifted upward and rotated about the rotating hinge fixture while maintaining the selective engagement of the engagement feature to the outer lip of the top end of the container body.

14. The apparatus of claim 1 wherein the bottom portion of the assembly body has a bottom portion shape that conforms to a shape of the container cover that is placed on the container cover to enclose the top end of the container body.

15. The apparatus of claim 1 wherein the bottom portion of the assembly body has a shape to conform to or receive the container handle when placed for selective attachment thereon.

16. The apparatus of claim 1 wherein at least one of the downward extending attachment feature and the assembly body are configured to cover the top end of the container body when the apparatus is placed onto the container body, but to not cover or obstruct use and access to the container handle when the apparatus is placed on the container body.

17. The apparatus of claim 1 wherein the assembly body includes a utility storage area, the utility storage area being configured for selective receiving and dispensing of user utilities including tools.

18. The apparatus of claim 17 wherein the utility storage area is formed in the assembly body to include one or more orifices for receiving tools.

19. The apparatus of claim 17 wherein the utility storage area includes a selectably enclosable storage compartment.

20. The apparatus of claim 1, further comprising a utility storage component configured for selective receiving and dispensing of user utilities including tools and includes a selective attachment feature for selectively attaching the utility storage feature to the assembly body, wherein the assembly body includes an attachment feature for engaging with and selectively securing the utility storage component to the assembly body by a user.

21. The apparatus of claim 20 wherein the utility storage component includes one or more orifices for receiving tools.

22. The apparatus of claim 20 wherein the utility storage component includes a selectably enclosable storage compartment.

23. The apparatus of claim 1 wherein the assembly body includes an orifice between the top surface and the bottom surface providing access from the top surface to the cavity of the container body after the assembly body and downward extending attachment feature are selectively engaged with the at least a portion of the top end of the container body.

24. The apparatus of claim 23 wherein the assembly body includes an orifice cover over the orifice configured to be selectably movable by a user to cover and to uncover the orifice.

25. The apparatus of claim 24 wherein the orifice cover is selected from the group consisting of a sliding door, a hinged door, and a plug.

26. The apparatus of claim 1 where at least one of the assembly body and the downward extending attachment feature coupled to the assembly body is composed of a material selected from the group consisting of a wood, a plastic, a metal, a composite.

27. The apparatus of claim 1 wherein at least one of the assembly body and the downward extending attachment feature coupled to the assembly body includes an assembly handle for aiding a user manipulation of the apparatus.

28. The apparatus of claim 1 wherein the assembly body has a shape of a rectangular, and wherein the downward extending attachment feature has a rectangular shape, the rectangular shape of the downward extending attachment feature having a shape and dimensions that conforms with a shape and dimensions of the top end of the container body for the selective attachment thereto.

29. The apparatus of claim 1 wherein the outer lip of the top end of the container is about the entire periphery of the top end of the container body, and wherein the downward extending feature is configured to abut and enclose the outer lip of the top end of the container body for the selective attachment of the apparatus to the portable trash/recycling container.

30. The apparatus of claim 1 wherein the assembly body includes a receptacle for providing easily accessible power to a user using the working surface of the apparatus.

* * * * *